United States Patent [19]

Berger

[11] 4,272,459

[45] Jun. 9, 1981

[54] CARBURETOR ACCELERATOR PUMP LOCKOUT SYSTEM

[75] Inventor: Alvin H. Berger, Wyandotte, Mich.

[73] Assignee: Ford Motor Company, Dearborn, Mich.

[21] Appl. No.: 138,794

[22] Filed: Apr. 8, 1980

Related U.S. Application Data

[63] Continuation of Ser. No. 959, Jan. 4, 1979, abandoned.

[51] Int. Cl.[3] ..... F02M 7/08

[52] U.S. Cl. ..... 261/34 A; 261/34 B; 261/DIG. 19

[58] Field of Search ..... 261/34 A, 34 B, DIG. 19

[56] References Cited

U.S. PATENT DOCUMENTS

| | | | |
|---|---|---|---|
| 2,026,788 | 1/1936 | Kirby | 261/34 A |
| 2,069,642 | 2/1937 | Briggs | 261/34 A |
| 2,214,964 | 9/1940 | Leibing | 261/DIG. 19 |
| 2,230,311 | 2/1941 | Seymour | 261/34 A |
| 2,551,719 | 5/1951 | Ball | 261/34 A |
| 2,732,193 | 1/1956 | Wentz, Jr. | 261/34 A |
| 2,771,282 | 11/1956 | Olson et al. | 261/34 A |
| 3,210,054 | 10/1965 | Gettell | 261/34 A |
| 3,251,585 | 5/1966 | Derengowski et al. | 261/34 B |
| 3,475,994 | 11/1969 | Kell | 261/34 A |
| 3,486,491 | 12/1969 | White | 261/DIG. 19 |
| 3,547,089 | 12/1970 | Pierlot | 261/DIG. 19 |
| 3,606,871 | 9/1971 | Gropp et al. | 123/117 A |
| 3,741,177 | 6/1973 | Schultz | 261/DIG. 19 |
| 3,757,611 | 9/1973 | Buck | 261/65 |
| 3,774,582 | 11/1973 | Masaki et al. | 261/65 |
| 3,886,240 | 5/1975 | Baldin et al. | 261/34 B |
| 3,996,904 | 12/1976 | Kobuki et al. | 261/DIG. 19 |
| 4,053,543 | 10/1977 | Pettitt | 261/DIG. 19 |

FOREIGN PATENT DOCUMENTS

| | | | |
|---|---|---|---|
| 2710687 | 9/1977 | Fed. Rep. of Germany | 261/34 A |
| 46-43050 | 12/1971 | Japan | 261/34 A |

*Primary Examiner*—Tim R. Miles

*Attorney, Agent, or Firm*—Robert E. McCollum; Clifford L. Sadler

[57] ABSTRACT

A carburetor accelerator pump lockout assembly having an actuating lever connected to the throttle valve shaft by a pin and cam slot connection, the lever pulling down on an accelerator pump lever upon opening movement of the throttle valve to actuate the pump to inject fuel into the carburetor induction passage; the lever having an extended portion adapted to be engaged by a vacuum controlled servo plunger to prevent pumping movement of the lever, vacuum being supplied to a servo chamber from an induction passage port past a number of flow delay devices that delay the decay of vacuum in the servo chamber for 4–5 seconds upon momentary return of the throttle valve to the idle speed position from the off idle position to prevent operation of the pump while permitting operation of the pump when the throttle valve is maintained in the idle speed position for longer than the 4–5 second period.

8 Claims, 1 Drawing Figure

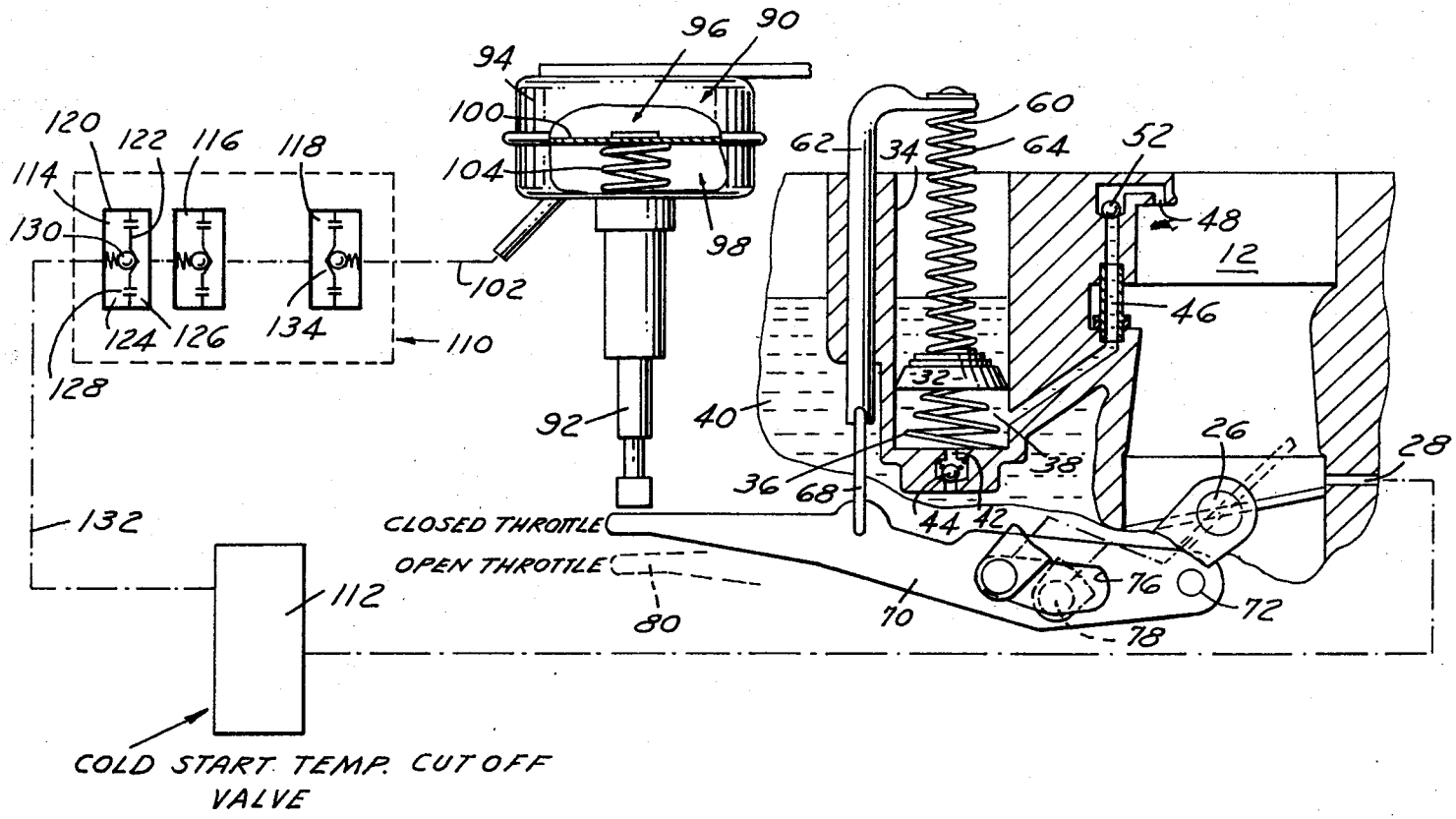
CLOSED THROTTLE
OPEN THROTTLE
COLD START TEMP. CUT OFF VALVE

CARBURETOR ACCELERATOR PUMP LOCKOUT SYSTEM

This is a Continuation of application Ser. No. 959, filed Jan. 4, 1979, now abandoned.

This invention relates in general to an accelerator pump assembly for an automotive type carburetor. More particularly, it relates to a lockout mechanism for improving emissions by preventing the operation of the accelerator pump during certain conditions of operation of the engine such as, for example, when the carburetor throttle valve is momentarily shifted from an off idle or open throttle position to a closed or idle speed position and quickly returned to the off idle position.

It is well recognized that it is important to control the quantity of fuel discharged into the carburetor induction passage from the accelerator pump system to control emissions. Therefore, it is important that no more fuel than is necessary to satisfy the engine requirements should be discharged. When a vehicle is equipped with a manually operated transmission, shifting of the transmission generally results in the vehicle operator momentarily releasing the accelerator pedal or throttle valve to its idle speed position while depressing the clutch pedal and changing gears and then redepressing the accelerator pedal or throttle valve within a span of only a few seconds to provide the engine speedup required to maintain the speed level previously attained. Since the accelerator pedal strokes the accelerator pump to discharge a shot of fuel into the induction passage, fuel will be supplied during each shift of the manual transmission as the accelerator pedal or throttle valve is returned to its off idle position. Eliminating this shot of fuel at this time may reduce the passage of unburned hydrocarbons into the atmosphere. One method is to disconnect the accelerator pump linkage; however, this may provide a hesitation on engine or vehicle driveaway; i.e., it may reduce the engine off idle driveability. Devices are known for controlling the operation of the accelerator pump for various purposes. Seymour U.S. Pat. No. 2,230,311, Fuel Ecomonizer for Automotive Engines, is an example of an engine manifold vacuum controlled servo controlling the operation of a power valve and/or the accelerating pump during certain periods and under certain conditions. However, Seymour does not show an accelerator pump lockout mechanism of the type provided by this invention.

Getell, U.S. Pat. No. 3,210,054, Carburetor Accelerator Pump Lockout, is another example of a mechanical lockout system; however, Gettell shows only a manual control rendering the accelerator pump operative or inoperative and does not operate during the specific conditions outlined above for this invention.

Kell, U.S. Pat. No. 3,475,994, Vehicle Speed Controlled Carburetor Accelerator Pump, shows just that—an accelerator pump that is controlled in response to vehicle speed. No control of the type described above for this invention is shown and described.

It is an object of this invention, therefore, to provide a carburetor with an accelerator pump system that not only provides good engine off idle driveability, but eliminates the discharge of fuel into the carburetor induction passage during shifting phases of the manual transmission. The invention accomplishes this by locking out the accelerator pump during the normal manual shifting procedure so as to prevent or render ineffective the accelerator pump and therefore eliminate the normal "shot of fuel" into the carburetor during these times. This is accomplished by controlling the pump stroke by a servo controlled by vacuum in a pressure port located above the closed position of the carburetor throttle valve, the vacuum line having vacuum delay means that allows the accelerator pump to discharge only after a prolonged period of the throttle valve at engine idle speed position but does not allow the pump to discharge during only a momentary closing of the throttle valve, such as during the shifting operation of a manual transmission.

It is another object of the invention, therefore, to provide a carburetor accelerator pump lockout mechanism to control the operation of the accelerator pump to prevent operation under certain conditions of operation of the carburetor throttle valve while permitting operation of the pump under other conditions of operation.

Other objects, features, and advantages of the invention will become more apparent upon reference to the succeeding detailed description thereof, and to the single FIGURE illustrating schematically a cross-sectional view of a carburetor embodying the invention.

The FIGURE shows a portion of a downdraft type carburetor having a conventional air/fuel mixture induction passage 12. The passage contains a conventional fixed area venturi and is open at its upper end to receive fresh air from the conventional air cleaner, not shown. Its lower end is adapted to be connected to the intake manifold of an internal combustion engine so as to be subject to the vacuum changes, for controlled purposes to be described.

Fuel is supplied to the induction passage from a float bowl or fuel reservoir 22 through a passage, not shown, upon the flow of air through passage 12, in a conventional manner. The passage 12 also contains a throttle valve or plate 24 fixed to a shaft 26 that is mounted in the sidewalls of the carburetor. The throttle valve moves between the full line engine idle speed essentially closed position to the engine off idle dotted line position indicated to control the flow of air and fuel through the passage. A pressure port 28 communicates with the induction passage at a location just above the edge of the throttle valve 24 when it is in its essentially closed or idle speed position so as to subject the pressure port to essentially atmospheric pressure at this time. The port is adapted to be traversed by the edge of the throttle valve as it moves from the solid line engine idle speed position to the engine off idle speed dotted line position so as to then subject the port to the level of vacuum in the intake manifold of the engine, for a purpose to be explained later. Further details of construction and operation of the carburetor per se other than those portions relating to the invention are not given since they are known and believed to be unnecessary for an understanding of the invention.

The accelerator pump shown in the FIGURE is for the most part conventional and includes a flexible cup type pump piston 32 vertically movable in a fuel well 34. A spring 36 biases the piston 32 upwardly on an induction stroke against a return spring 60 to fill the cavity 38 between the piston 32 and well 34 with fuel from the float bowl 22 through a passage 42 past a floating ball check valve 44. The well is connected by a discharge passage 46 to a nozzle outlet 48 discharging the fuel into the induction passage 12, past a floating ball check valve 52.

The pump piston 32 is connected to an actuating lever 62 by a rod 64 that projects slidably through lever 62 and is spaced from it by spring 60 bearing against the piston and lever. Lever 62 is connected by a tension type link 68 to one end of an actuating lever 70 pivotally mounted at its rightward end 72. Lever 70 has a lost motion pin and cam slot type connection with the throttle valve, the lever having a cam slot 76 slidably engaging a pin 78 that is operably fixed to the shaft 26 of the throttle valve 24. The cam slot is so shaped that when the throttle valve 24 is in the idle speed full line position shown, the accelerator pump return spring 60 will move the lever 70 upwardly to the position shown, this being permitted by the shape of the cam slot cooperating with the pin 78.

When the throttle valve 24 is rotated to the dotted line off idle position rotation of shaft 26 will cam the lever 70 to its second position indicated by dotted lines 80, which constitutes the accelerator pump pumping position. That is, camming down of the lever 70 by rotation of the throttle valve 24 will cause the link 68 to pull the lever 62 downwardly and move the pump piston 32 against the spring 36 to discharge the fuel in well 38 through passage 46 into the carburetor induction passage 12. So long as the throttle valve remains in its open off idle position, the accelerator pump will remain in its discharged position.

As stated previously, it is an object of this invention to provide a means to lockout the accelerator pump system when the manual transmission is shifted, so that when the throttle valve is temporarily moved to a closed position and then quickly returned to an open position, the accelerator pump will not operate. This is accomplished by providing means to maintain the lever 70 in its down or non-pumping position during the shifting operation. More particularly, the FIGURE shows a servo mechanism 90 having a plunger 92 that is reciprocatable for engagement with the lever 70 at times to prevent lever movement and for disengagement at other times from the lever to permit its normal accelerator pump operation.

Servo 90 itself is essentially conventional having an outer housing 94 divided or partitioned into an atmospheric air chamber 96 and a vacuum chamber 98 by an annular flexible diaphragm member 100. The air chamber 96 is connected to atmosphere by a vent (not shown), while the vacuum chamber 98 is connected by passage means or tubing 102 to the carburetor induction passage pressure port 28 through control means to be described. A spring 104 normally biases the diaphragm 100 and plunger 92 to which it is attached in an upward direction out of engagement with the lever 70. Application of vacuum to chamber 98 will cause a downward extension of the plunger 92 to abut the lever 70 when in the lower open throttle position 80 and thereby prevent return of lever 70 to its upper position moving the accelerator pump through its discharge stroke.

Flow of vacuum from pressure port 28 to the servo 90 is controlled by two controls 110 and 112. 112 is simply a temperature responsive on/off type valve, not shown, which below a predetermined temperature level will be in the off position and not permit the flow of vacuum from port 28 to servo 90. The effect of this is to render ineffective the servo 90 and not permit operation of the accelerator pump system.

The second control 110 contains three flow delay or control valves 114, 116 and 118. Each of these is of a similar construction and each similar to that fully shown and described in U.S. Pat. No. 3,606,871, Gropp et al, assigned to the assignee of this invention. More specifically, each of the control valves includes a housing partitioned by an annular flexible diaphragm 122 into two pressure chambers 124 and 126. Communication between the chambers is afforded in one path by a pair of circumferentially spaced flow controlling orifices 128 providing slow communication between the chambers, and in a second bypass path by a one-way ball check valve or a pressure relief valve 130 providing quick communication between the chambers when unseated. The two control valves 114 and 116 are similarly oriented so that when the pressure on the upstream side or carburetor port side is higher than that in chamber 126 on the servo side, the check valve 130 will be closed and only slow communication of pressure between chambers 124 and 126 will be obtained.

The two delay devices 114, 116 are in series and combine the delay time to provide essentially a four to five second delay in communication of any higher pressure in line 132 to the servo line 102. The control device 118 on the other hand is reversed in operation in that the check valve 134 is operatively located opposite to the check valves 130 of devices 114 and 116.

In operation, with the engine off, and assuming the engine operating temperature is above the level that opens the on/off valve 112, the parts will be positioned as shown in full line. The throttle valve 24 will be in its engine idle or essentially closed position permitting the lever 70 to be moved upwardly to the full line position shown by the accelerator pump return spring 36. The servo spring 104 will move the diaphragm 100 upwardly and thereby cause the plunger 92 to be moved in the same direction out of engagement with the lever 70. The chambers 124, 126 on both sides of the diaphragms of the control devices 114, 116 and 118 will be at atmospheric pressure and the check valves 130, 134 will all be closed. The well 38 of the accelerator pump will be filled with fuel and be ready for discharge into the carburetor upon movement of the pump in its pumping stroke.

Assume now that the engine has been started and that the throttle valve is in the full line idle speed position shown. The pressure port 28 will be subjected to atmospheric pressure from the inlet of the induction passage, which will maintain the flow control devices 114, 116, and 118 and servo 90 in the same position as during the engine off condition. If now the throttle valve 24 is rotated open to its off idle dotted line position, the pin 78 will rotate and cam the lever 70 downwardly to the dotted line position 80. It simultaneously will pull down the accelerator pump actuating lever 62 to move the pump piston 32 downwardly and discharge the fuel in well 38 through passage 46 and nozzle 48 into the induction passage 12 to provide the "shot of fuel" needed for accelerating purposes. At the same time, the pressure port 28 will now be exposed to intake manifold vacuum which will flow through the pressure control valve 112 to the flow control device 114. Since the check valve 130 is positioned to open when the pressure in chamber 124 is less than that in chamber 126, which is atmospheric at this time, the check valve will open and immediately permit the vacuum to be communicated to flow control device 116. Again, the check valve 130 in the flow device 116 will open immediately and provide vacuum to the flow control device 118. The check valve 134 in this case is oppositely operative in the line and, therefore, will remain closed causing communication from the port 28 to servo line 102 to occur only slowly through the orifices 128. This delay can be, for example, 1–2 seconds, to eliminate sudden movements of the throttle valve causing a reaction at the servo.

After the 1–2 second delay vacuum applied to the servo chamber 98 draws the diaphragm 100 downwardly to move the plunger 92 in the same direction and therefore engage the end of lever 70 in the dotted line position. With the plunger in this dotted line position, the lever 70 will be prevented from moving upwardly to reprime the accelerator pump when the throttle valve is returned from the off idle or open position to the engine idle speed or closed full line position. The purpose of this is, as stated before, to prevent operation of the accelerator pump when the manual transmission is shifted and the accelerator pedal is momentarily moved from an off idle position to the idle position and returned. When this occurs, the closing of the throttle valve again subjects the pressure port 28 to atmospheric pressure which is communicated to the flow control devices 114 and 116. Since the atmospheric pressure is now higher than the vacuum in chambers 126, the check valve 130 in each of the devices 114 and 116 will close and permit communication to the device 118 only through the orifices 128 which are now in series with respect to the flow devices 114 and 116. This will cause a combined delay of approximately 4–5 seconds before the atmospheric pressure in line 132 can be communicated to the flow control device 118. This 4–5 second delay is sufficiently long to permit the manual shifting of the transmission and a return of the throttle valve to its open or off idle position without the injection of a shot of fuel into the induction passage.

On the other hand, if during a coasting operation, or for some other reason, the throttle valve is returned to the idle speed position and maintained in that position for longer than 4–5 seconds, the atmospheric pressure in line 132 will then be communicated past the flow control devices 114 and 116 to the flow control device 118. The check valve 134 will then open immediately and communicate the atmospheric pressure to vacuum chamber 98 in the servo 90. This will immediately decay the vacuum and allow the spring 104 to move the plunger 92 upwardly. This will permit the accelerator pump return spring 38 to move the pump system 32 upwardly and thus move the lever 70 in the same direction to the full line position shown corresponding to closed throttle position. This will also permit the induction of fuel into the well 38 past the ball check valve 44 to reprime the accelerator pump well. Therefore, when the throttle pedal is moved to a closed throttle position for an extended period of time, longer than 4–5 seconds, for example, subsequent depression of the accelerator pedal and movement of the throttle valve to its off idle position will cam the lever 70 downwardly to the dotted line position and cause accelerator pump to operate to inject a shot of fuel into the induction passage.

While the invention has been shown and described in its preferred embodiment, it will be clear to those skilled in the arts to which it pertains that many changes and modifications may be made thereto without departing from the scope of the invention.

I claim:

1. An accelerator pump assembly for a carburetor having a rotatable throttle valve controlled induction passage connected to an engine intake manifold, including an accelerator pump movable from an original non-pumping position through a pumping stroke to inject fuel into the induction passage, and linkage means connecting the throttle valve and pump for moving the pump through its pumping stroke upon movement of the throttle valve from an engine idle speed essentially closed position to an off idle engine accelerating position, spring means returning the pump to its original position to reprime the pump, and control means preventing actuation of the pump through its pumping stroke when the throttle valve is moved from the off idle speed position to the idle speed position and quickly returned to the off idle speed position within a predetermined period of time, the connecting means including a pivotal lever operably connecting the throttle valve and pump and a pin and cam slot connecting the lever and throttle valve whereby movement of the throttle valve from an off idle speed position to the idle speed position cams the lever from a pumping position to a non-pumping position whereby return movement of the throttle valve to an off idle position cams the lever to actuate the pump, and stop means in the path of movement of the lever to prevent movement of the lever to the pumping position in response to a predetermined movement of the throttle valve, including a vacuum controlled servo having plunger means movable at times to engage the lever and retractible to a non-engaged position, vacuum passage means connecting the servo to the carburetor induction passage at a location above the idle speed position of the throttle valve so as to subject the passage means to atmospheric pressure when the throttle valve is in the idle speed position to effect movement of the servo plunger means to the non-engaged position with the lever and to subject the passage means to engine manifold vacuum when the throttle valve is moved to the off idle speed position to effect movement of the servo to move the plunger means to engage the lever and prevent actuation of the pump, the control means including vacuum delay means in the vacuum passage means operable to control the servo to prevent actuation of the pump during a momentary return of the throttle valve to the idle speed position from an off idle position while permitting actuation of the pump upon maintenance of the throttle valve in the idle speed position for longer than the predetermined time period.

2. An assembly as in claim 1, the vacuum delay means including a plurality of flow restricting orifices in series flow arrangement and an equal number of pressure relief check valves in parallel bypass arrangement with the orifices, the pressure relief valves being effective in flow directions opposite to each other.

3. An assembly as in claim 1, the delay means including first flow restricting orifice means in the passage means, a line bypassing the orifice means and containing first check valve means closed by higher pressure on the upstream carburetor passage side than on the downstream servo side and operable by higher servo pressure than carburetor passage pressure, a second orifice in the passage means downstream of the first orifice means and check valve means, and a second bypass line bypassing the second orifice and containing a second check valve closed by higher servo pressure than carburetor passage pressure and operable by higher carburetor passage pressure than servo pressure, the second orifice providing a shorter time delay than the first orifice means.

4. An accelerator pump assembly for a carburetor having an air/fuel induction passage connected to an engine intake manifold and having a throttle valve mounted for a rotatable movement across the passage from an engine idle speed essentially closed throttle position to an engine off idle speed position, a pressure port in the induction passage at a location just above the edge of the throttle valve when in the idle speed position so as to be traversed by the edge as the throttle valve moves to the off idle position to change the pressure in the port from essentially atmospheric to the level of the vacuum in the intake manifold, the accelerator pump assembly including a pumping member movable in one direction from one position on a pumping stroke to inject fuel into the induction passage and spring movable in a return direction to the one position, a lever pivotally movable and connected to the pumping member and movable from a first position positioning the pump in its one non-pumping position to a second position moving the pump on its pumping stroke, lost motion means connecting the lever and throttle valve for movement at times of the lever to the second position in response to movement of the throttle valve from the idle speed position to the off idle speed position and for return movement of the lever to the first position at other times upon return movement of the throttle valve to the idle speed position, and control means operable in response to changes in the pressure in the pressure port upon movement of the throttle valve to the idle speed position followed by a quick return to the off idle position within a predetermined time period to prevent movement of the lever from its first position to its second pump pumping position, the control means including means permitting movement of the lever to the second position upon the throttle valve remaining in the idle speed position for a period longer than the predetermined time period.

5. An assembly as in claim 4, the control means including servo means having a plunger spring urged in one direction out of engagement with the lever and moved by vacuum in the opposite direction into engagement with the lever when the lever is in the first pump non-pumping position to maintain the lever in the first position, vacuum passage means connecting the servo to the induction pressure port whereby movement of the throttle valve to the off idle position directs manifold vacuum to the servo to move the plunger to engage the lever in its first pump non-pumping position and return movement of the throttle valve to the idle speed position directs atmospheric pressure to the servo permitting a spring return of the plunger to a position out of engagement with the lever permitting return movement of the lever to its second position upon movement of the throttle valve to its off idle position, and vacuum flow control means in the vacuum passage means controlling the decay of vacuum at the servo and the return movement of the plunger and movement of the lever to the second position upon return movement of the throttle valve to the idle speed position for a period no longer than the predetermined time period.

6. An assembly as in claim 5, the delay means including first flow restricting orifice means in the passage means, a line bypassing the orifice means and containing first check valve means closed by higher pressure on the upstream carburetor passage side than on the downstream servo side and operable by higher servo pressure than carburetor passage pressure, a second orifice in the passage means downstream of the first orifice means and check valve means, and a second bypass line bypassing the second orifice and containing a second check valve closed by higher servo pressure than carburetor passage pressure and operable by higher carburetor passage pressure than servo pressure, the second orifice providing a shorter time delay than the first orifice means.

7. An assembly as in claim 6, the lost motion means including a pin and cam slot type connection.

8. An assembly as in claim 7, the lever having a cam slot slidably receiving a pin therein operably connected to the shaft of the throttle valve, movement of the throttle valve camming the lever from its first position to the second position actuating the pump on its pumping stroke.

* * * * *